US009324495B2

(12) United States Patent
Fontana, Jr. et al.

(10) Patent No.: US 9,324,495 B2
(45) Date of Patent: Apr. 26, 2016

(54) PLANAR INDUCTORS WITH CLOSED MAGNETIC LOOPS

(71) Applicant: International Business Machines Corporation, Armonk, NY (US)

(72) Inventors: Robert E. Fontana, Jr., San Jose, CA (US); William J. Gallagher, Ardsley, NY (US); Philipp Herget, San Jose, CA (US); Eugene J. O'Sullivan, Nyack, NY (US); Lubomyr T. Romankiw, Briancliff Manor, NY (US); Naigang Wang, Ossining, NY (US); Bucknell C. Webb, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 183 days.

(21) Appl. No.: 14/044,112

(22) Filed: Oct. 2, 2013

(65) Prior Publication Data

US 2015/0064362 A1 Mar. 5, 2015

Related U.S. Application Data

(63) Continuation of application No. 14/017,729, filed on Sep. 4, 2013.

(51) Int. Cl.

| | |
|---|---|
| ***H01F 27/24*** | (2006.01) |
| ***H01F 41/04*** | (2006.01) |
| ***H01F 3/10*** | (2006.01) |
| ***H01F 17/06*** | (2006.01) |
| ***H01F 41/14*** | (2006.01) |

(52) U.S. Cl.

CPC ..... *H01F 41/04* (2013.01); *H01F 3/10* (2013.01); *H01F 17/06* (2013.01); *H01F 41/14* (2013.01)

(58) Field of Classification Search

CPC ..... H01F 2017/067

See application file for complete search history.

(56) References Cited

U.S. PATENT DOCUMENTS

| | | | | |
|---|---|---|---|---|
| 4,262,233 | A * | 4/1981 | Becker et al. | 315/248 |
| 5,062,197 | A * | 11/1991 | Ngo et al. | 29/606 |
| 6,288,870 | B1 | 9/2001 | Saliba | |
| 6,303,971 | B1 | 10/2001 | Rhee | |
| 7,936,246 | B2 | 5/2011 | Hopper et al. | |
| 2002/0050905 | A1 * | 5/2002 | Okita et al. | 336/110 |
| 2006/0226947 | A1 | 10/2006 | Pauley, Jr. et al. | |
| 2008/0074230 | A1 * | 3/2008 | Chen et al. | 336/212 |
| 2008/0075975 | A1 * | 3/2008 | Glaser et al. | 428/693.1 |
| 2008/0106364 | A1 | 5/2008 | Orlando et al. | |

(Continued)

OTHER PUBLICATIONS

Frommberger et al., "Integration of Crossed Anisotropy Magnetic Core Into Toroidal Thin-Film Inductors", IEEE Transactions on Microwave Theory and Techniques, vol. 53, No. 6, Jun. 2005, pp. 2096-2100.

(Continued)

*Primary Examiner* — Mandy Louie

(74) *Attorney, Agent, or Firm* — Cantor Colburn LLP; Vazken Alexanian

(57) ABSTRACT

A planar closed-magnetic-loop inductor and a method of fabricating the inductor are described. The inductor includes a first material comprising a cross-sectional shape including at least four segments, at least one of the at least four segments including a first edge and a second edge on opposite sides of an axial line through the at least one of the at least four segments. The first edge and the second edge are not parallel.

9 Claims, 3 Drawing Sheets

(56) References Cited

U.S. PATENT DOCUMENTS

| | | | |
|---|---|---|---|
| 2012/0233849 | A1 | 9/2012 | Smeys et al. |
| 2013/0056847 | A1 | 3/2013 | Chen |

OTHER PUBLICATIONS

Gardner et al., "Integrated on-chip inductors using magnetic material (invited)", Journal of Applied Physics, vol. 103, 2008, pp. 1-6.

Wang et al., "Integrated on-chip inductors with electroplated magnetic yokes (invited)", Journal of Applied Physics, vol. 111, 2012, pp. 1-6.

Wright et al., "Analysis of Integrated Solenoid Inductor with Closed Magnetic Core", IEEE Transactions on Magnetics, vol. 46, No. 6, Jun. 2010, pp. 2387-2390.

Xing et al., "High-Bandwidth Low-Insertion Loss Solenoid Transformers Using FeCoB Multilayers" IEEE Transactions on Power Electronics, vol. 28, No. 9, Sep. 2013, pp. 4395-4401.

* cited by examiner

PLANAR INDUCTORS WITH CLOSED MAGNETIC LOOPS

CROSS-REFERENCE TO RELATED APPLICATION

This application is a continuation of U.S. application Ser. No. 14/017,729 filed Sep. 4, 2013, the disclosure of which is incorporated by reference herein in its entirety.

BACKGROUND

The present invention relates to magnetic inductors and transformers, and more specifically, to planar closed magnetic flux loops. Magnetic inductors and transformers are passive elements with applications in power converters and radio frequency (RF) integrated circuits (ICs) or chips, for example. Magnetic inductors include a set of coils to carry the currents and a magnetic yoke or core to store magnetic energy. Because of the reluctance or magnetic resistance of air gaps, a closed magnetic loop is desirable to facilitate high inductance. Other considerations are the in-plane uniaxial anisotropy requirement for magnetic materials and the planar nature of on-chip devices.

SUMMARY

According to one embodiment of the present invention, a planar closed-magnetic-loop inductor includes a first material comprising a cross-sectional shape including at least four segments, at least one of the at least four segments including a first edge and a second edge on opposite sides of an axial line through the at least one of the at least four segments, wherein the first edge and the second edge are not parallel.

According to another embodiment of the present invention, a method of fabricating a planar closed loop inductor includes depositing a first material to form a cross-sectional shape of the inductor including at least four segments, at least one of the at least four segments including a first edge and a second edge on opposite sides of an axial line through the at least one of the at least four segments, wherein the first edge and the second edge are not parallel; and applying a magnetic bias in a first direction.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

As noted above, planar inductors/transformers are needed for use on a chip or integrated circuit. A closed magnetic flux loop formed inside the magnetic yoke/core of an inductor/transformer facilitates achieving a high inductance density or a high coupling coefficient. However, the planar nature of the on-chip inductors often requires the inductor yoke/core to have an in-plane uniaxial anisotropy so that the magnetization of the yoke/core can fully respond to the magnetic field generated by the inductor coils. This in-plane uniaxial anisotropy of magnetic materials is usually induced during material deposition or post-annealing in a dc magnetic field. With this constraint of the in-plane uniaxial anisotropy, it is challenging to form a closed magnetic flux path for the on-chip inductors. For example, traditional solenoidal inductors with magnetic cores have two ends of the core open so that the magnetic flux cannot be closed inside the core. Previous reported methods of connecting the ends of the core by simply adding magnetic materials at the ends (e.g. rectangular or round shapes) will not close the magnetic flux in the core due to the uniaxial anisotropy of the core. The result structure works like two inductors with big air gaps between inductor cores, which will dramatically decrease the inductance or coupling coefficient. One method of forming a closed flux loop uses two layers of magnetic yokes, connected at the ends through magnetic vias, which enclose a set of copper coils. However, because processing of the magnetic materials can be the most difficult part of inductor fabrication, the need for two layers of magnetic materials makes this method challenging. Another approach uses cross-anisotropy induced during magnetic film deposition and involves a magnetic core composed of multiple layers of magnetic materials with the anisotropy of two adjacent layers being perpendicular. However, because only half of the magnetic materials are functioning at a time, twice the amount of magnetic materials is needed for a given level of performance. Embodiments of the device and method described herein relate to shape anisotropy that modulates the anisotropy at the ends of the core of a solenoidal inductor. As detailed below, angles are chosen at the ends of the core such that the shape anisotropy changes the direction of magnetization continuously to close magnetic flux at the ends of the core.

Figure 1:
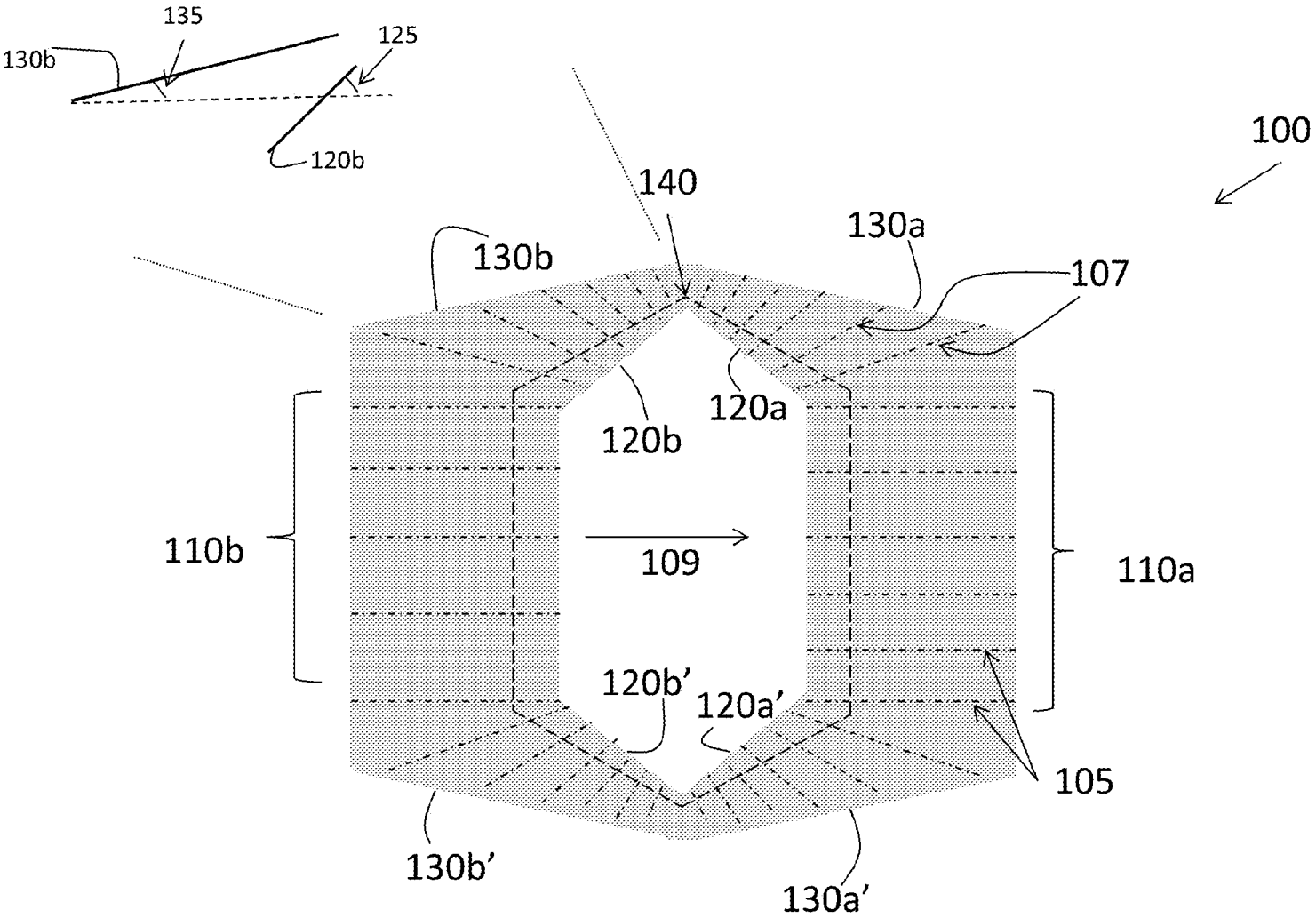
FIG. 1 illustrates an exemplary inductor core shape according to an embodiment of the invention.

FIG. 1 illustrates an exemplary inductor core 100 shape according to an embodiment of the invention. Because of the planar nature of on-chip elements, the (two-dimensional) cross-sectional illustration of the inductor core 100 shown in FIG. 1 may be regarded as representing the inductor core 100 shape for most purposes, including the determination of the magnetization direction. The inductor core 100 may be comprised of any soft magnetic materials such as nickel iron (Ni—Fe), cobalt iron (Co—Fe), cobalt zirconium tantalum (Co—Zr—Ta), cobalt tungsten phosphorus (Co—W—P), or ferrite, for example. The inductor core 100 may alternately be comprised of cobalt nickel iron (CoNiFe), iron nickel phosphorous (FeNiP), or cobalt iron phosphorous (CoFeP), for example. The magnetic materials may be deposited by electroplating, electroless plating, sputtering, evaporation, or any other magnetic film deposition technique. A (direct current) magnetic bias is applied in the direction shown by the arrow 109 during magnetic core deposition or post-annealing at high temperature. For the main body of the core 100 (i.e. 110*a* and 110*b*), the domain patterns will show a strong preference so that the domain walls, indicated by the dashed lines 105 (edge-closure domains not shown), lie parallel to the induced easy axis which is in the same direction as 109. The induced easy axis is the favorable direction of spontaneous magnetization based on the direction of application of the magnetic bias (109). At the ends of the core 100 (outlined by 130*a*, 130*b*, 130*a*' and 130*b*'), as FIG. 1 illustrates, the domain walls, indicated by the dashed lines 107, are not in one direction in all parts of the inductor core 100. That is, while the magnetic bias applied along the direction 109 is one source of energy used during the fabrication of the inductor core 100, the shape anisotropy is another source of energy that affects the easy axis that is ultimately established for the overall inductor core 100. As shown in FIG. 1, the material is arranged such that the easy axis (indicated by 105 and 107) rotates at the two ends as shown (above and below segments 110*a*, 110*b* in FIG. 1). This rotation (due to the shape anisotropy) and how it is achieved are discussed below. The flux 140 direction is perpendicular to the easy axis (105, 107). Thus, FIG. 1 illustrates that, based on the shape anisotropy, a closed loop flux 140 results.

The inductor core 100 includes two parallel straight segments 110*a*, 110*b* each having the same easy axis as indicated by the dashed lines 105 in FIG. 1. The easy axis (105) of the straight segments 110 corresponds with the magnetic bias direction 109 applied during deposition or post annealing of the material. The inductor core 100 also includes four additional segments defined by inner edges 120*a*, 120*b*, 120*a*', 120*b*' and corresponding outer edges 130*a*, 130*b*, 130*a*', 130*b*'. The shape anisotropy discussed above that facilitates the easy axis (107) in those four segments to be differently oriented than the easy axis (105) in the straight segments 110 requires that the inner edges 120 and outer edges 130 of the four segments to be non-parallel. That is, the inner edge 120*a* is not parallel to the corresponding outer edge 130*a*, the inner edge 120*b* is not parallel to the corresponding outer edge 120*b*, the inner edge 120*a*' is not parallel to the corresponding outer edge 130*a*', and the inner edge 120*b*' is not parallel to the corresponding outer edge 130*b*'. The angles of formation for the inner edge 120*b* and the outer edge 130*b* are detailed as 125 and 135, respectively. The angles are offset from an edge (top edge according to the view of FIG. 1) of the straight segments 110. These angles of formation 125, 135 are not equal, thereby resulting in non-parallel edges 120*b* and 130*b*. The specific angles at which each of the inner and outer edges 120, 130 is formed may be calculated or determined experimentally and may be based, for example, on the material composition of the inductor core 100. A relative angle of formation 125, 135 may be determined for the inner edge 120 and outer edge 130. By having different angles of formation for inner edges 120 versus corresponding outer edges 130, the easy axis 105 shown in the four segments in FIG. 1 and, consequently, the closed loop flux 140 shown in FIG. 1 are achieved.

Figure 2:
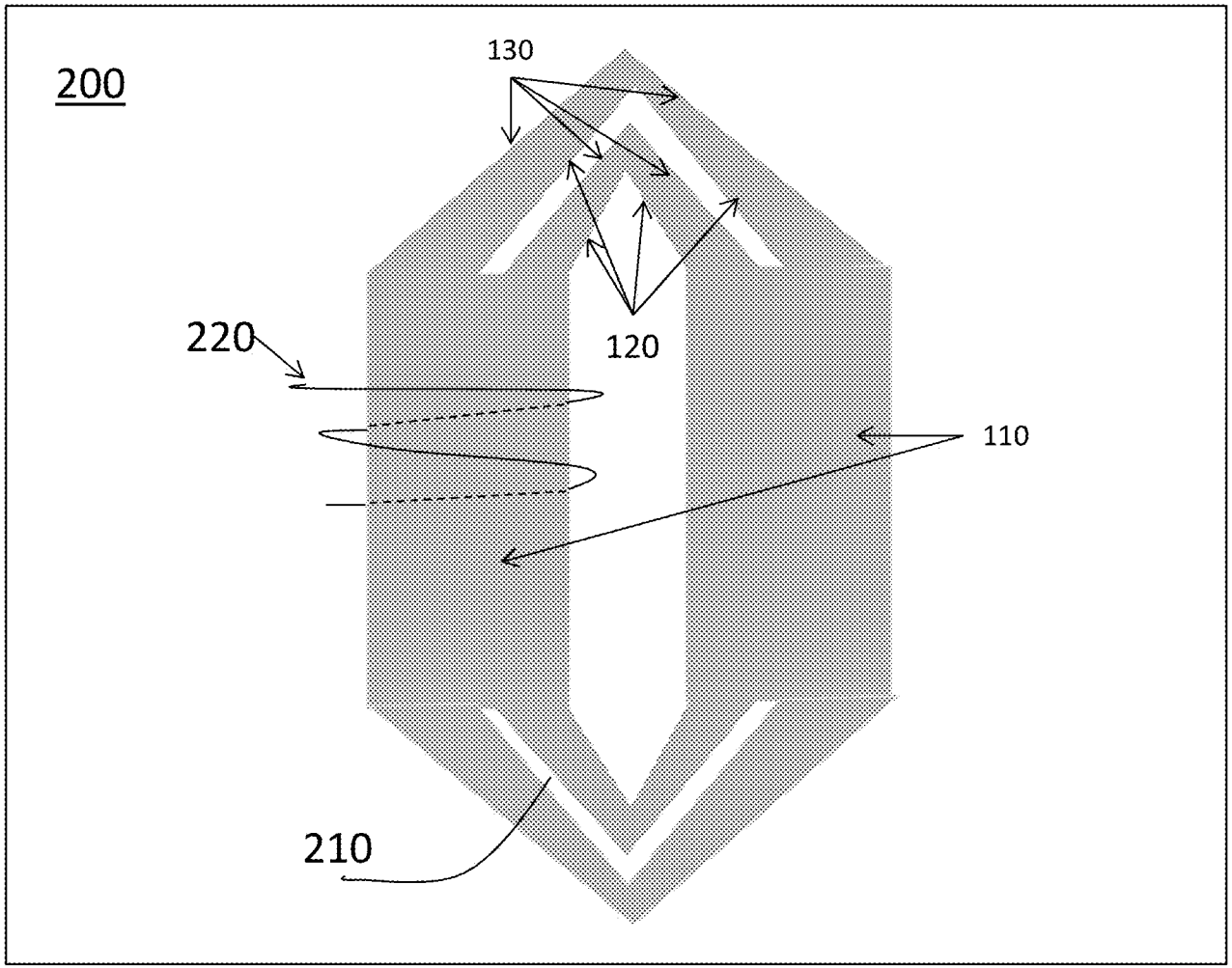
FIG. 2 shows an inductor core according to another embodiment of the invention.

FIG. 2 shows an inductor core 100 according to another embodiment of the invention. The inductor core 100 shown in FIG. 2 is formed on a substrate 200 and includes two parallel straight segments 110 like those shown in FIG. 1. According to the embodiment shown in FIG. 2, the additional segments with non-parallel inner edges 120 and corresponding outer edges 130 include one or more gaps 210 therebetween. The gap 210 facilitates the use of less material in the non-parallel segments as compared with the embodiment shown in FIG. 1, for example. Each of the inner edges 120 may be formed at the same or at different angles, and each of the outer edges 130 may be formed at the same or at different angles, as long as an inner edge 120 is formed at a different angle than its corresponding outer edge 130 such that the inner edge 120 and outer edge 130 are not parallel. As noted in the discussion of FIG. 1, the specific angle selected for the inner and outer edges 120, 130 may be based on the material used for the inductor core 100, for example. FIG. 2 shows some of the coil 220 that is wrapped around an inductor core 100 to form the inductor.

Figure 3:
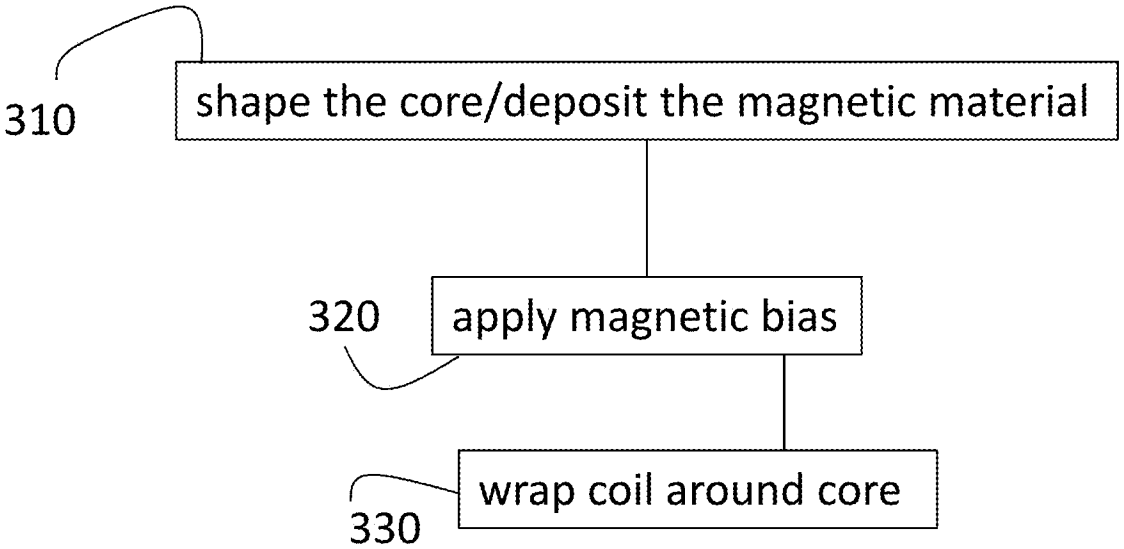
FIG. 3 is a process flow of a method of fabricating an inductor with an inductor core according to embodiments of the invention.

FIG. 3 is a process flow of a method of fabricating an inductor with an inductor core 100 according to embodiments of the invention. At block 310, shaping the core (depositing the magnetic material, e.g., Ni—Fe, on a substrate) includes forming non-parallel sides (edges 120, 130) for at least some of the segments comprising the inductor core 100 as shown by the exemplary inductor cores 100 of FIGS. 1 and 2. As noted above, the specific shape may be based on the material comprising the inductor core 100. This shape anisotropy modulates the anisotropy that would be established otherwise based on the material. At block 320, applying a magnetic bias is in a direction as indicated by 109 in FIG. 1. The application of the magnetic bias may be during deposition/shaping (at block 310) or after annealing the material of the inductor core 100. Without the shape anisotropy modulation at block 310, the easy axis of all of the inductor core 100 would be established in the direction of the magnetic bias. Blocks 310 and 320 represent the application of two different forms of energy in the fabrication of the inductor core 100 and in determining how the magnetization aligns within the material comprising the inductor core 100. As noted above, they may be performed in parallel (with the magnetic bias applied during deposition) or in sequence (with the magnetic bias applied after the material is deposited/annealed). Block 330 includes wrapping coil 220 (e.g., wire) around the inductor core 100 through which current flows.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method of fabricating a planar closed loop inductor, the method comprising:

depositing a first material on a substrate to form a cross-sectional shape of the inductor including at least four segments, at least one of the at least four segments including a first edge and a second edge on opposite sides of an axial line through the respective at least one of the at least four segments, wherein the first edge is an innermost edge of the cross-sectional shape, the second edge is an outermost edge of the cross-sectional shape, and the first edge and the second edge are not parallel; and applying a magnetic bias in a first direction of the first material.

2. The method according to claim 1, wherein the first material may be comprised of nickel iron (Ni—Fe), cobalt iron (Co—Fe), cobalt zirconium tantalum (Co—Zr—Ta), cobalt tungsten phosphorus (Co—W—P), ferrite, cobalt nickel iron (CoNiFe), iron nickel phosphorous (FeNiP), or cobalt iron phosphorous (CoFeP).

3. The method according to claim 1, wherein the applying the magnetic bias is done during the depositing.

4. The method according to claim 1, wherein the applying the magnetic bias is after the depositing and annealing the first material.

5. The method according to claim 1, further comprising forming a second material as a coil around the first material.

6. The method according to claim 1, wherein the at least four segments include a first segment, a second segment, a third segment, and a fourth segment, the first segment and the second segment are parallel rectangular shapes, both the first segment and the second segment include a first rectangular edge on a first side and a second rectangular edge on a second side, the first segment is separated from the second segment by the third segment at the first side, and the first segment is separated from the second segment by the fourth segment at the second side.

7. The method according to claim 6, wherein the applying the magnetic bias in the first direction is along the first rectangular edge and the second rectangular edge.

8. The method according to claim 1, further comprising determining angles of formation relative to the axial line through the respective at least one of the at least four segments of the first edge, the second edge, another first edge within the respective at least one of the at least four segments, and another second edge within the respective at least one of the at least four segments based on a composition of the first material.

9. The method according to claim 6, further comprising determining, for each of the at least one of the at least four segments, an angle of formation of the first edge relative to an angle of formation of the second edge and an angle of formation of another first edge within the respective at least one of the at least four segments relative to an angle of formation of another second edge within the respective at least one of the at least four segments based on a composition of the first material.

* * * * *